US005682937A

United States Patent [19]

Decrane et al.

[11] Patent Number: 5,682,937

[45] Date of Patent: Nov. 4, 1997

[54] CLOSING DEVICES INCORPORATING ROLLING MEANS

[75] Inventors: Pierre Decrane, Velet; Bernard Roy, Gray, both of France

[73] Assignees: SIMU, Arc Les Gray; Aluroy, Ancier, both of France

[21] Appl. No.: 629,051

[22] Filed: Apr. 8, 1996

[30] Foreign Application Priority Data

Apr. 14, 1995 [FR] France ..... 95 04762

[51] Int. Cl.[6] ..... E06B 9/08

[52] U.S. Cl. ..... 160/133; 160/241; 160/273.1

[58] Field of Search ..... 160/133, 273.1, 160/241, 201, 235, 209, 232, 236, 323.1

[56] References Cited

U.S. PATENT DOCUMENTS 5,579,820 12/1996 LePage et al. ..... 160/323.1 X

FOREIGN PATENT DOCUMENTS

| | | | |
|---|---|---|---|
| 2024777 | 12/1971 | Germany | 160/133 |
| 2525600 | 11/1976 | Germany . | |
| 3433846 | 3/1986 | Germany . | |
| 641310 | 8/1962 | Italy | 160/133 |
| 503884 | 4/1971 | Switzerland . | |

*Primary Examiner*—Blair Johnson

*Attorney, Agent, or Firm*—Dowell & Dowell

[57] ABSTRACT

Closures such as rolling shades or blinds which include a drum for winding slats of the closure body and which are formed by two superposed shafts. Separation devices are provided adapted to prevent any friction between layers of slats wound on the shafts. These devices may include stepped pulleys associated with slat end pieces of different lengths.

7 Claims, 5 Drawing Sheets

CLOSING DEVICES INCORPORATING ROLLING MEANS

BACKGROUND OF THE INVENTION

1. Field of the Invention

The present invention relates to blinds, rolling shades and other closing devices comprising a deformable shade body adapted to wind on a drum rotated by a drive mechanism.

2. History of the Related Art

With a view to reducing the dimensions of the drum when the shade body is wound thereon, it has been proposed to constitute the drum by two parallel shafts which are oriented transversely in superposition substantially along the axis of the shade body. A first of these two shafts is joined to the upper edge of the shade body, while the other is kinematically connected to the first shaft, while being free to rotate at a slightly different speed so that, when this first shaft is driven by the drive mechanism, the shade body simultaneously winds on the two superposed shafts.

Documents DE-A-34 33 846 (HORMANN KG), DE-A-25 25 600 (HARTMANN & Cie) and CH-A-503 884 (GRIESSER) clearly illustrate this known technique.

However, trials have proved disappointing, as unwinding of the shade body (descent) by gravity under the effect of the slat fixed to the lower edge of the shade body is effected under poor conditions, giving rise to frequent dysfunctions that the operator has to overcome by making a manual pulling effort on the lower part of the shade body.

It is an object of the present invention to overcome this practical drawback.

SUMMARY OF THE INVENTION

To that end, the present invention relates to a wound closing device of the blind, rolling shade and like type, in which the deformable shade body winds, under the effect of a drive mechanism, on a drum formed by two parallel shafts which are oriented transversely in superposition substantially to the axis of the shade body and of which one, joined to the upper edge of the shade body, is driven by the drive mechanism while the other is kinematically connected to the first while being free to rotate at a slightly different speed of rotation, characterized in that the winding device comprises separation means adapted to avoid any contact between the successive layers or turns of the shade body wound on one and the other of the shafts which form the drum.

In fact, the invention is based on the observation that the dysfunctions which are encountered in practice during descent of the blind in the case of drums with two shafts, are due to the effect of friction which appears between the layers or turns of slats wound contiguously on the drum, and the invention essentially consists in providing the closing device with separation means adapted to avoid any contact between the the layers or turns.

Such separation means may be in different forms. In particular, stepped pulleys may be mounted on the ends of each of the two superposed shafts having cheeks of different diameters selectively form bearings for the ends of the slats of the shade body or for endpieces secured to the ends, these slats or endpieces being established, in series, with different lengths.

An equivalent result is obtained by providing the ends of the slats with rollers of different diameters, adapted to cooperate, series by series, with independent tracks of the same diameter borne by the ends of the two superposed shafts.

BRIEF DESCRIPTION OF THE DRAWINGS

The invention will be more readily understood on reading the following description with reference to the accompanying drawings, in which.

DESCRIPTION OF PREFERRED EMBODIMENT

Figure 1:
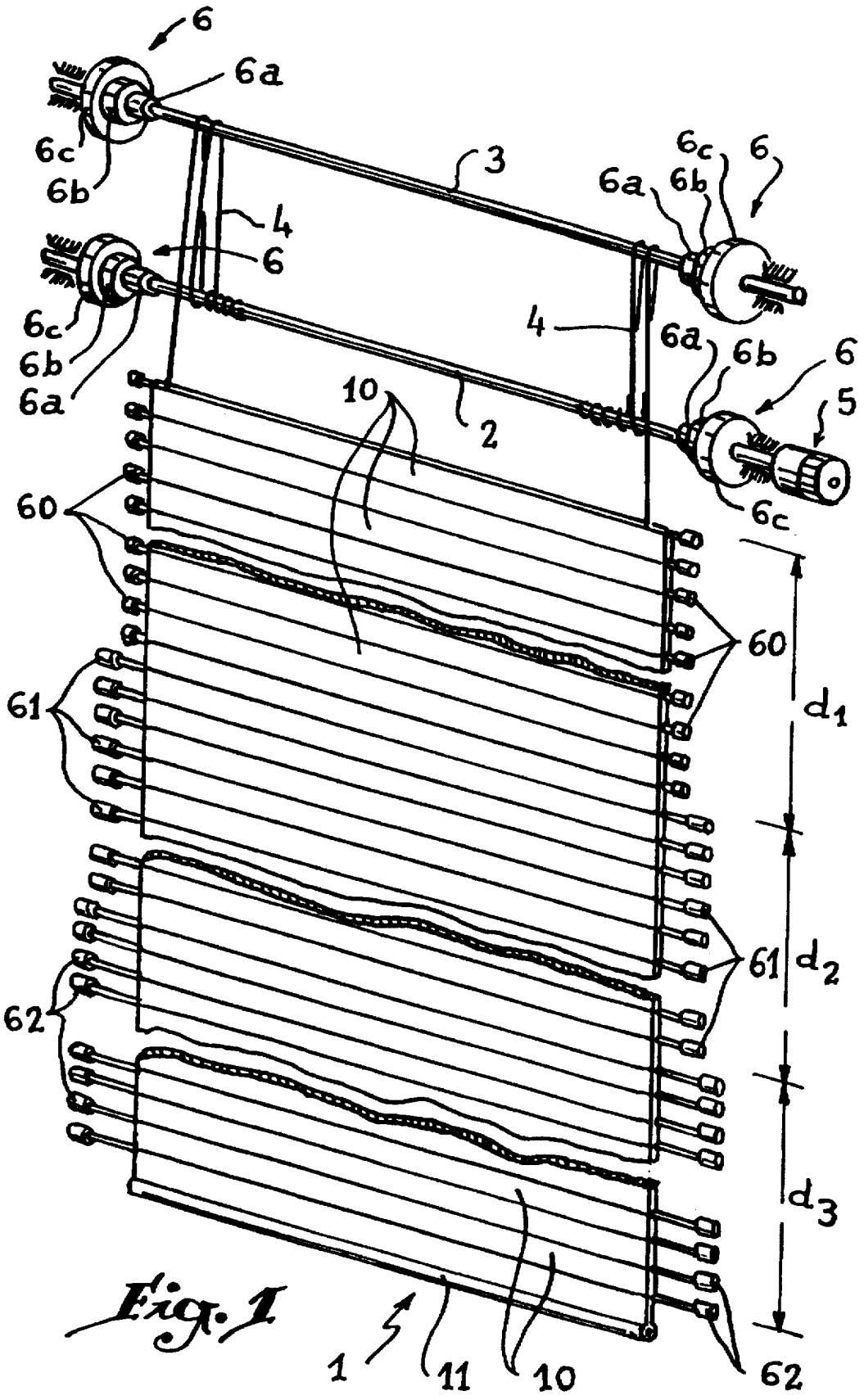
FIG. 1 is a schematic view in perspective illustrating the general arrangement of a blind with articulated slats according to the invention.

Referring now to the drawings, the closing device shown in FIG. 1 is formed by a shade of which the body 1 is constituted in manner known per se by a series of horizontal slats 10, assembled together by their horizontal edges with the aid of an articulated system which leaves them free to orient differently in a vertical plane.

The drum intended for winding this shade body 1 is constituted, in manner known per se, by two horizontal shafts 2 and 3 supported by a fixed frame (not shown) so as to be disposed one below the other along the vertical axis of the body 1. On the lower shaft 2 is fixed one of the ends of two cables 4 which, after some turns wound on the shaft 2, rise vertically to pass over the upper shaft 3, redescend to shaft 2, rising again to pass over shaft 3 towards the upper edge of the shade body 1, the free end of each cable 4 finally being fastened to the upper slat 10 of the shade body.

With the lower shaft 2 there is associated a mechanism for rotation which, in the case shown, is formed by an electric gear motor 5. It will be understood that, when this is set into action in the suitable direction of rotation, winding of the cables 4 on the lower shaft 2 provokes corresponding winding of the shade body 1, the slats 10 thereof being obliged to follow the path of the cables and to wind successively on the two shafts 2 and 3, which thus constitute the drum for winding the shade body. The two shafts 2 and 3 are joined with the aid of the two cables 4 which, by sliding, enable the upper shaft 3 to rotate at a speed slightly different from that of shaft 2, while being driven by friction to accompany the shade body 1 to some extent.

However, it goes without saying that this mode of "sliding" connection between the two shafts 2 and 3 may be replaced by any other appropriate system, particularly by a torque limiter mechanism.

Furthermore, it should be observed that, if, for unwinding the shade body (covering the opening with which the blind is associated), the direction of rotation of the gear motor 5 is reversed, the shade body 1 descends under the effect of the weight of the slat 11 provided at the lower end of the body. The effect of gravity frequently proves insufficient to ensure descent in the event of the layers of slats wound on the two shafts 2 and 3 being contiguous, the effect of friction in that case being too great, and it is in order to overcome this drawback that the present invention provides the device with separation means adapted to avoid mutual contact of the layers or turns of slats wound on the shafts.

Figure 2:
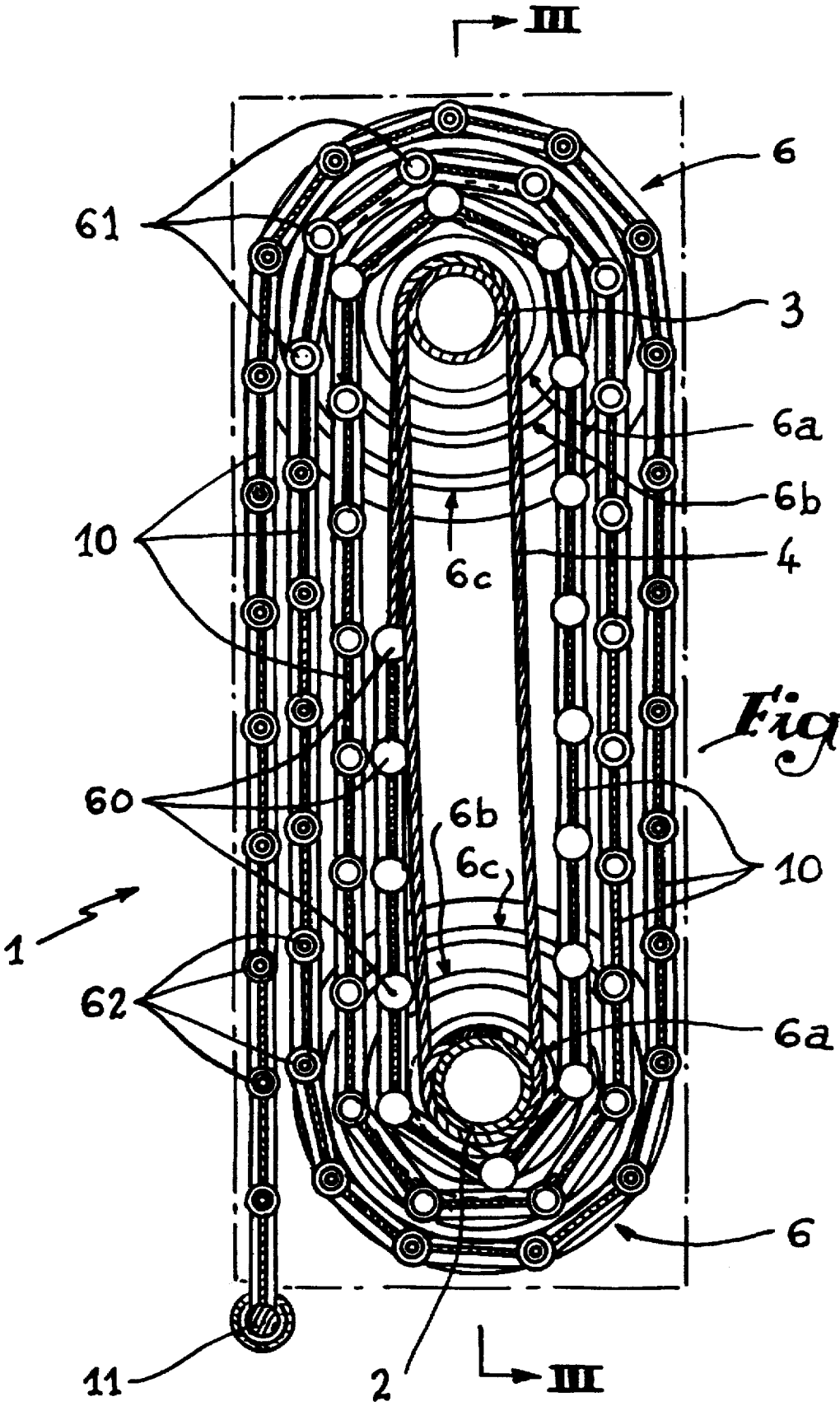
FIG. 2 is a transverse section, on a larger scale, showing the blind-winding drum according to FIG. 1, in the totally open position of the shade body.
Figure 3:
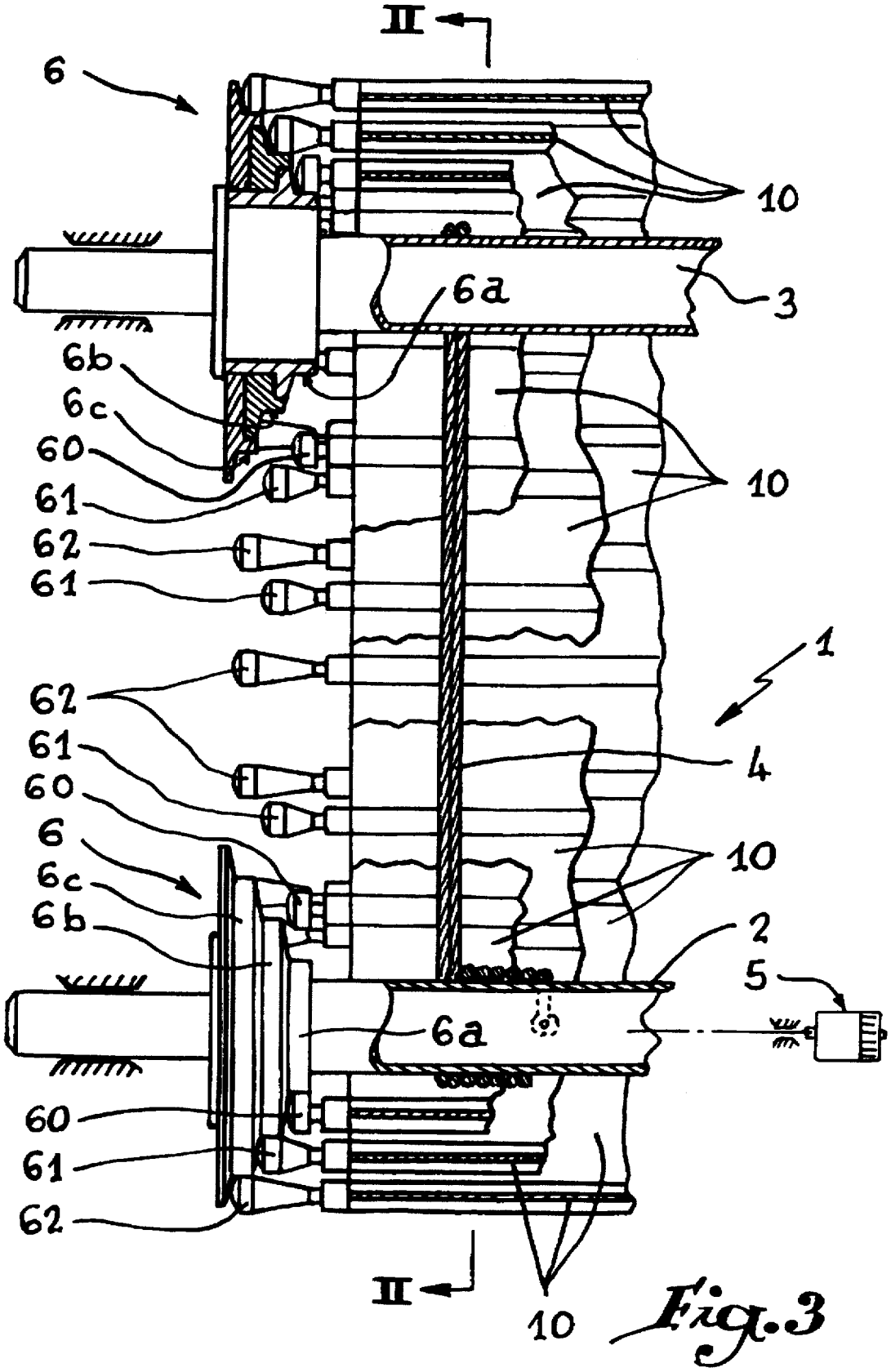
FIG. 3 is a vertical section along plane III—III of FIG. 2; in this Figure, the plane of section of FIG. 2 appears at II—II.
Figure 4:
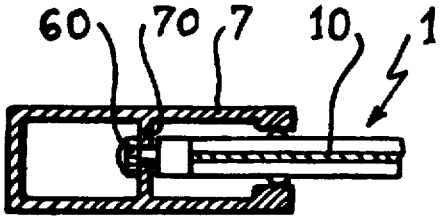
FIGS. 4, 5 and 6 are detailed sections showing lateral guiding of the different slats of the blind.
Figure 5:
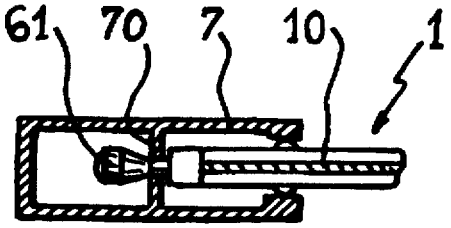
Figure 6:
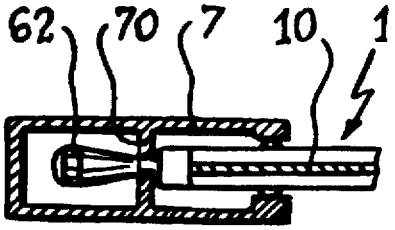

In the embodiment shown in FIGS. 1 to 6, the desired result is obtained by providing each of the shafts 2 and 3 with two stepped pulleys 6 which are mounted idly on the shaft shown, while being axially retained in place in the vicinity of one of the ends thereof; as shown more particularly in FIG. 3, each pulley 6 is in fact formed by three independent cheeks 6*a*, 6*b* and 6*c* with increasing diameters. Furthermore, there are fixed at the ends of the slats 10 of the shade body 1 three types of endpieces 60, 61 and 62 which differ from one another by their length; as shown in FIG. 1, over a height d1 of shade body 1, the slats 10 are equipped with short endpieces 60, over a height d2, with average endpieces 61, and over a height d3 with long endpieces 62. FIGS. 4, 5 and 6 clearly show that, whatever the length of their projecting part, the different endpieces 60, 61 and 62 are suitably guided by a perforated strut or partition 70 provided in the two lateral slides 7 of the blind device.

It will be appreciated that, during winding of the shade body 1 upon rotation of the two shafts 2 and 3, the endpieces 60 first come into contact with the small-diameter cheeks 6*a* of the stepped pulleys 6; endpieces 61 then abut in turn against cheeks 6*b*, the long endpieces 62 bearing, at the end of winding, against the large-diameter cheeks, as shown in FIGS. 2 and 3.

By suitably dimensioning the thickness of the endpieces and exactly calculating the positioning of these endpieces on the slats 10 of the shade body, any friction between the layers of slats wound on the two shafts 2 and 3 is avoided. The shade body 1 may thus be unwound without jerks, in the same manner as in the conventional blind devices.

Figure 7:
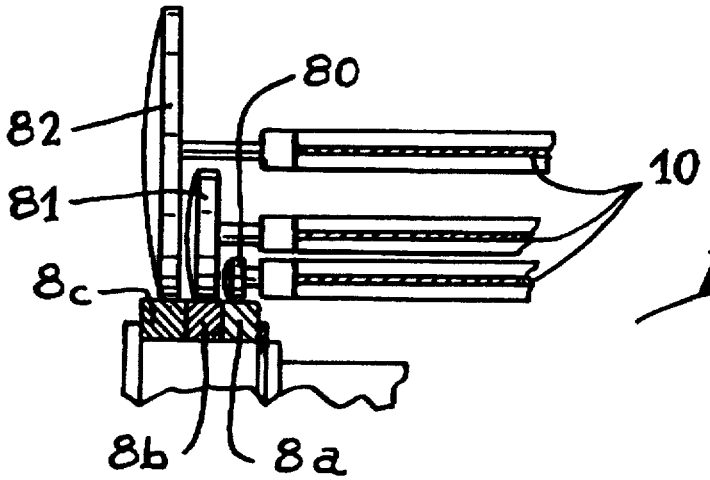
FIG. 7 shows a variant embodiment of the invention.

An equivalent result is obtained by providing the ends of the slats 10 with endpieces established, in series, with different lengths and provided with rollers 80, 81 and 82 of different diameters (cf. FIG. 7), which rollers roll against independent tracks 8*a*, 8*b* and 8*c* of the same diameter, mounted idly at each of the ends of the shafts 2 and 3.

Figure 8:
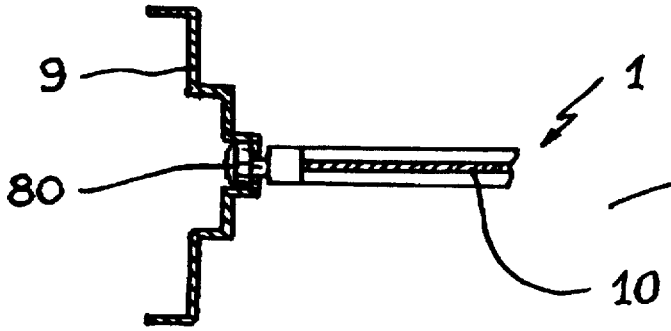
FIGS. 8, 9 and 10 schematically show the guiding of the slats in the variant of FIG. 7.
Figure 9:
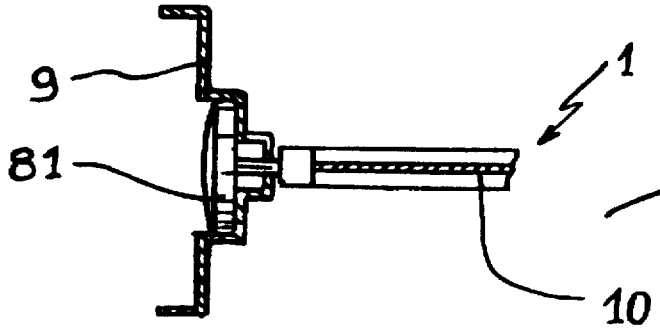
Figure 10:
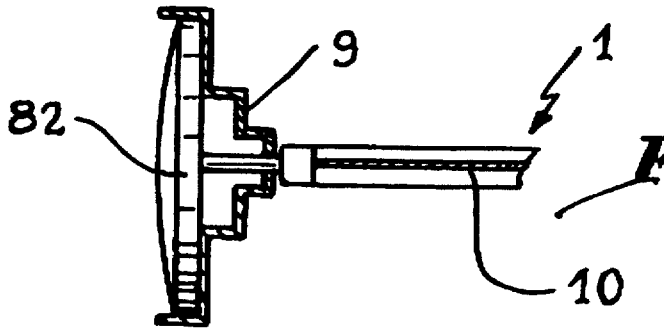

FIGS. 8, 9 and 10 illustrate the lateral guiding of the vertical edges of the shade body 1 with the aid of slides 9 of stepped inner section, adapted to offer the terminal rollers 80, 81 and 82 three different runways.

Figure 11:
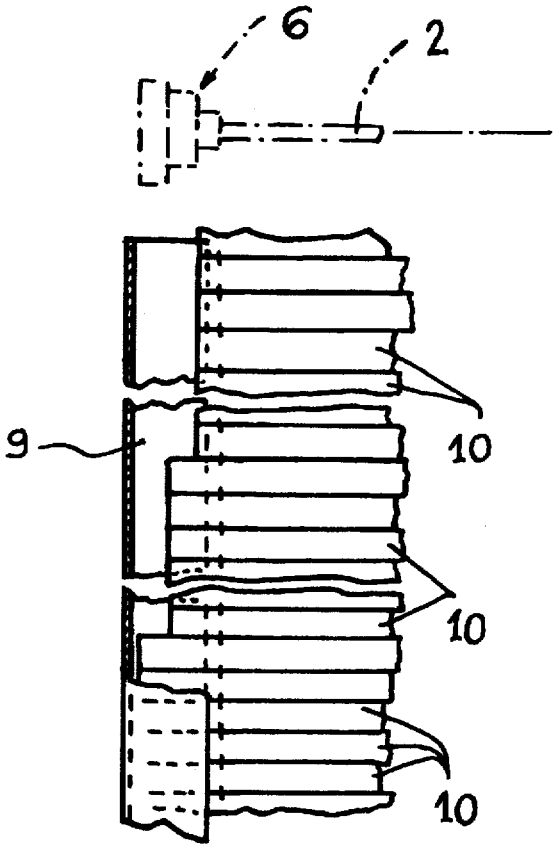
FIG. 11 illustrates another variant embodiment.

Other forms of embodiment for the separation means may be imagined. For example, instead of adding endpieces 60, 61 and 62 at the ends of slats 10, it is these slats which are directly established, in series, with different lengths, so as to cooperate with the cheeks of the stepped pulleys 6, as schematically indicated in FIG. 11. In such a case, it is of course indispensable that the slats 10 be clipped together in order to avoid any untimely longitudinal displacement and that the slides 9 have a sufficient depth to ensure guiding of the shortest slats 10.

What is claimed is:

1. In a roll up closure having a body consisting of a plurality of articulated slats which extend generally perpendicular to an elongated vertical axis of the body and wherein the slats are adapted to be wound on a drum formed of first and second parallel shafts each having opposite ends and each being oriented transversely to the elongated vertical axis of the body and in spaced vertical relationship to one another, and wherein an upper edge of the body is secured to the first shaft which is rotated at a first rate of rotation by a drive mechanism and wherein the second shaft is kinematically connected to the first shaft in such a manner so as to rotate at a different rate than the first rate, the improvement comprising, stepped pulley means idly mounted to each of the opposite ends of the first and second shafts and forming a plurality of generally circular cheeks of differing diameters, the slats of the body being formed as a plurality of separate series of slats with each series of slats having ends of different lengths from series to series such that each of said plurality of cheeks form a bearing surface for supporting the ends of a separate one of said series of slats as the body is wound and unwound relative to the first and second shafts.

2. The roll up closure of claim 1 wherein the opposite ends are integrally formed with the slats.

3. The roll up closure of claim 1 wherein the opposite ends are formed as separate end pieces, the end pieces of each separate series of slats being generally the same length and differing in length from the end pieces of the other series of slats.

4. The roll up closure of claim 3 including vertical partitions extending along the opposite ends of the slats and each having a guide slot therein through which said separate end pieces extend.

5. In a roll up closure having a body consisting of a plurality of articulated slats which extend generally perpendicular to an elongated vertical axis of the body and wherein the slats are adapted to be wound on a drum formed of first and second parallel shafts each having opposite ends and being oriented transversely to the elongated vertical axis of the body and in spaced vertical relationship to one another, and wherein an upper edge of the closure body is secured to the first shaft which is rotated at a speed by a drive mechanism and wherein the second shaft is kinematically connected to the first shaft in such a manner so as to rotate at a different speed than the first shaft, the improvement comprising, generally circular bearing means idly mounted to each of the opposite ends of the first and second shafts and having generally equal diameters, the slats of the body being formed of a plurality of separate series of slats with each series of slats having ends of different lengths from series to series of the slats, rollers mounted to the opposite ends of each said slats, and said rollers of each separate series of slats having substantially the same diameter and with the rollers of each separate series of slats being different than the diameter of rollers of other of the separate series of slats.

6. The roll up closure of claim 5 including vertically extending track means for cooperatively guiding each of said rollers vertically relative to the first and second shafts.

7. The roll up closure of claim 6 wherein said opposite ends are formed as separate end pieces, said end pieces of each of each separate series of slats being generally the same length and said end pieces of each of the separate series of slats differing in length from other of the separate series of slats.

* * * * *